US012714202B2

(12) United States Patent
Huang et al.

(10) Patent No.: US 12,714,202 B2
(45) Date of Patent: Aug. 25, 2026

(54) SHOE COUNTER ASSEMBLY AND SHOE

(71) Applicant: SHENZHEN STARLINK NETWORK TECHNOLOGY CO., LTD., Shenzhen (CN)

(72) Inventors: Jie Huang, Shenzhen (CN); Yufeng Tsai, Shenzhen (CN)

(73) Assignee: Shenzhen Starlink Network Technology Co., Ltd., Shenzhen (CN)

( * ) Notice: Subject to any disclaimer, the term of this patent is extended or adjusted under 35 U.S.C. 154(b) by 9 days.

(21) Appl. No.: 19/184,001

(22) Filed: Apr. 21, 2025

(65) Prior Publication Data

US 2025/0241411 A1 Jul. 31, 2025

Related U.S. Application Data

(63) Continuation-in-part of application No. PCT/CN2024/089334, filed on Apr. 23, 2024.

(30) Foreign Application Priority Data

Dec. 5, 2023 (CN) ..... 202323323382.5

(51) Int. Cl.
*A43B 23/17* (2006.01)

(52) U.S. Cl.
CPC ..... *A43B 23/17* (2013.01)

(58) Field of Classification Search
CPC ..... A43B 23/08; A43B 23/088; A43B 7/20; A43B 13/41; A43B 23/28; A43B 11/02; A43B 23/16; A43B 23/17
(Continued)

(56) References Cited

U.S. PATENT DOCUMENTS 369,766 A * 9/1887 Barney ..... A43B 23/28 36/58.5
2,713,216 A * 7/1955 Ponce ..... A43B 23/16 36/68

(Continued)

FOREIGN PATENT DOCUMENTS

CN 210054797 U 2/2020
CN 216059415 U 3/2022

(Continued)

OTHER PUBLICATIONS

Translation of KR-100750833-B1 (Year: 2007).*

(Continued)

*Primary Examiner* — Grady Alexander Nunnery
(74) *Attorney, Agent, or Firm* — Ming Jiang; OPENPTO US LLC

(57) ABSTRACT

Provided are a shoe counter assembly and a shoe. The shoe counter assembly includes a supporting member and a wrapping member. The supporting member includes a first side and a second side opposite to each other. The wrapping member protruding from the first side in a direction away from the second side, wherein the wrapping member includes a first projection and a second projection arranged in sequence along a height direction of the shoe counter assembly. Two ends of the first projection and the second projection being connected to each other such that a continuous curved surface is formed on a side of the wrapping member opposite to the supporting member along the height direction.

17 Claims, 8 Drawing Sheets

(58) Field of Classification Search
USPC ..... 36/58.6, 68, 69, 92
See application file for complete search history.

(56) References Cited

U.S. PATENT DOCUMENTS

| | | | | | |
|---|---|---|---|---|---|
| 4,594,798 | A * | 6/1986 | Autry | ..... | A43B 23/17<br>36/114 |
| 2023/0284748 | A1 * | 9/2023 | Weeks | ..... | A43B 23/047 |

FOREIGN PATENT DOCUMENTS

| | | | | | |
|---|---|---|---|---|---|
| CN | 218605336 | U | 3/2023 | | |
| CN | 219762621 | U | 9/2023 | | |
| JP | 4142085 | B1 | 8/2008 | | |
| KR | 100713700 | B1 * | 5/2007 | ..... | A43B 23/28 |
| KR | 100750833 | B1 * | 8/2007 | ..... | A43B 23/088 |
| TW | M591779 | U | 3/2020 | | |

OTHER PUBLICATIONS

Translation of KR-100713700-B1 (Year: 2007).*
WIPO, International Search Report for PCT Application No. PCT/CN2024/089334, Jun. 24, 2024.

* cited by examiner

SHOE COUNTER ASSEMBLY AND SHOE

CROSS-REFERENCE TO RELATED APPLICATIONS

This application is the continuation in part of international application No. PCT/CN2023/089334, titled "SHOE COUNTER ASSEMBLY AND SHOE", filed on Apr. 23, 2024, which claims priority to Chinese Patent Application No. 202323323382.5, titled "SHOE COUNTER ASSEMBLY AND SHOE" filed on Dec. 5, 2023. The entire contents of aforementioned applications are hereby incorporated by reference in their entirety.

TECHNICAL FIELD

The present disclosure relates to the field of shoes, and in particular, it relates to a shoe counter assembly, and a shoe.

BACKGROUND

Shoes are indispensable daily necessities in people's daily life. With the continuous improvement of living standards, people have higher and higher requirements for the comfort of shoes. Due to different shapes of foot heels, the fit between the foot heels of different people and shoe heels varies. Some people are prone to foot abrasion when wearing shoes, and some people are prone to heel slippage of shoe when wearing the shoes since the shoes cannot be worn tightly.

SUMMARY

Embodiments of the present disclosure provides a shoe counter assembly and a shoe.

The shoe counter assembly in the embodiments of the present disclosure includes a supporting member having a first side and a second side opposite to each other, and a wrapping member protruding from the first side in a direction away from the second side, wherein the wrapping member comprises a first projection and a second projection arranged in sequence along a height direction of the shoe counter assembly. Two ends of the first projection and the second projection being connected to each other such that a continuous curved surface is formed on a side of the wrapping member opposite to the supporting member along the height direction.

The shoe according to the embodiments of the present disclosure includes the shoe counter assembly mentioned above and an upper, and the shoe counter assembly is connected with the upper.

Additional aspects and advantages of the present disclosure are partly set forth in the following description, and are partly obvious from the following description, or may be learned by practice of the present disclosure.

BRIEF DESCRIPTION OF THE DRAWINGS

The above and/or additional aspects and advantages of the present disclosure are obvious and easily understandable from the description of the embodiments made in combination with the following drawings, in which.

DETAILED DESCRIPTION OF EMBODIMENTS

Figure 1:
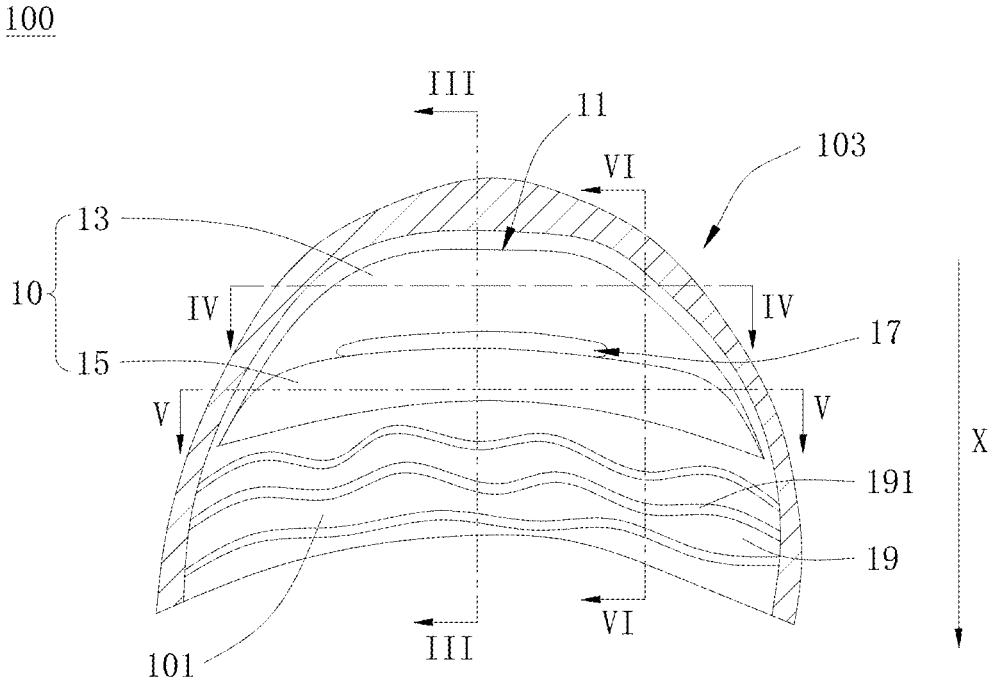
FIG. 1 is a schematic structural view of a shoe counter assembly in some embodiments of the present disclosure.

In order to make the above objects, features and advantages of the present disclosure more obvious and easy to understand, the specific embodiments of the present disclosure are described in detail with the attached drawings. In the following description, numerous specific details are set forth in order to provide thorough understanding of the present disclosure. However, the present disclosure may be implemented in many other ways different from those described here, and those skilled in the art may make similar improvements without departing from the idea of the present disclosure. Thus, the present disclosure is not limited by the specific embodiments disclosed below.

In the description of the present disclosure, it is understandable that, an orientation or positional relationship indicated by terms "center", "longitudinal", "transverse", "length", "width", "thickness", "up", "down", "front", "back", "left", "right", "vertical", "horizontal", "top", "bottom", "inside", "outside", "clockwise", "counterclockwise", "axial", "radial" and "circumferential" and the like, are based on the orientation or positional relationship illustrated in the attached drawings, which are only for the convenience of describing the present disclosure and simplifying the description, rather than indicating or implying that the referred devices or elements must have a specific orientation, be constructed and operated in a specific orientation' therefore, such relationship shall not be construed as limitation of the present disclosure.

In addition, terms "first" and "second" are only used for descriptive purposes, and may not be construed as indicating or implying relative importance or implicitly indicating the number of indicated technical features. Therefore, a feature defined by "first" and "second" may explicitly or implicitly indicate that there are at least one such feature. In the description of the present disclosure, "plurality/multiple" means at least two, such as two, three and more, unless otherwise specifically and explicitly defined.

In the present disclosure, unless otherwise explicitly specified and defined, terms "install", "joint", "connect" and "fix" should be understood in a broad sense. For example, it may be a fixed connection, a detachable connection or integrally formed; it may be a mechanical connection or an electrical connection; it may be directly connected or indirectly connected through an intermediary, or it may be an internal connection between two elements or interaction between two elements, unless otherwise specifically defined. For those ordinary skilled in the art, the specific meanings of the above terms of the present disclosure may be understood according to a specific circumstance.

In the present disclosure, unless otherwise explicitly specified and defined, a first feature "on" or "under" a second feature may indicate that the first and second features are in direct contact, or the first and second features are in indirect contact through an intermediary. Moreover, the first feature "above", "on" or "over" the second feature may mean that the first feature is directly above or obliquely above the second feature, or just means that the horizontal height of the first feature is higher than that of the second feature. The first feature "below", "under" and "beneath" the second feature may mean that the first feature is directly below or obliquely below the second feature, or just mean that the horizontal height of the first feature is lower than that of the second feature.

It is notable that, when an element is described as being "fixed" or "provided" on another element, the element may be directly on the another element or there may further be an intervening element therebetween. When an element is construed as being "connected" to another element, the element may be directly connected to the another element or an intervening element may further exist therebetween. Terms "vertical", "horizontal", "up", "low", "left" and "right" and similar expressions used in the description are only for the purpose of illustration, which do not represent an exclusive embodiment.

Shoes are indispensable daily necessities in people's daily life. With the continuous improvement of living standards, people have higher and higher requirements for the comfort of shoes. Due to different shapes of foot heels, the fit between the foot heels of different people and shoe heels varies. Some people are prone to foot abrasion when wearing the shoes, and some people are prone to heel slippage of shoe when wearing shoes since the shoes cannot be worn tightly. In order to reduce the problems, the embodiments of the present disclosure provide a shoe counter assembly 100 (illustrated in FIG. 1) and a shoe 1000 (illustrated in FIG. 8), which at least reduces the problems of foot abrasion and heel slippage of shoe when the shoe is worn.

Figure 2:
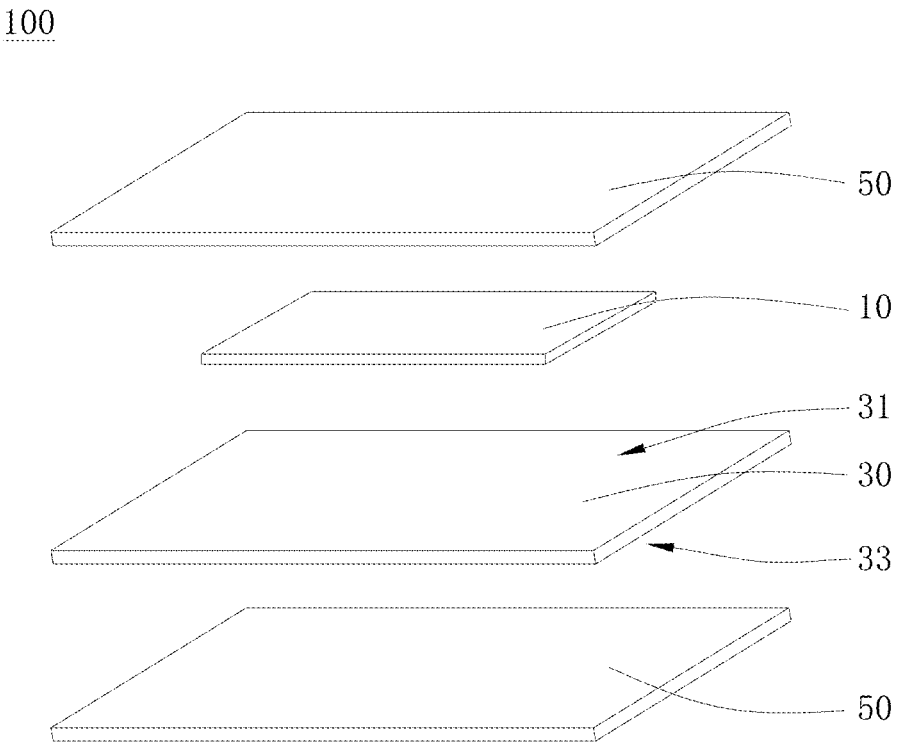
FIG. 2 is an exploded schematic view of the shoe counter assembly illustrated in FIG. 1.
Figure 3:
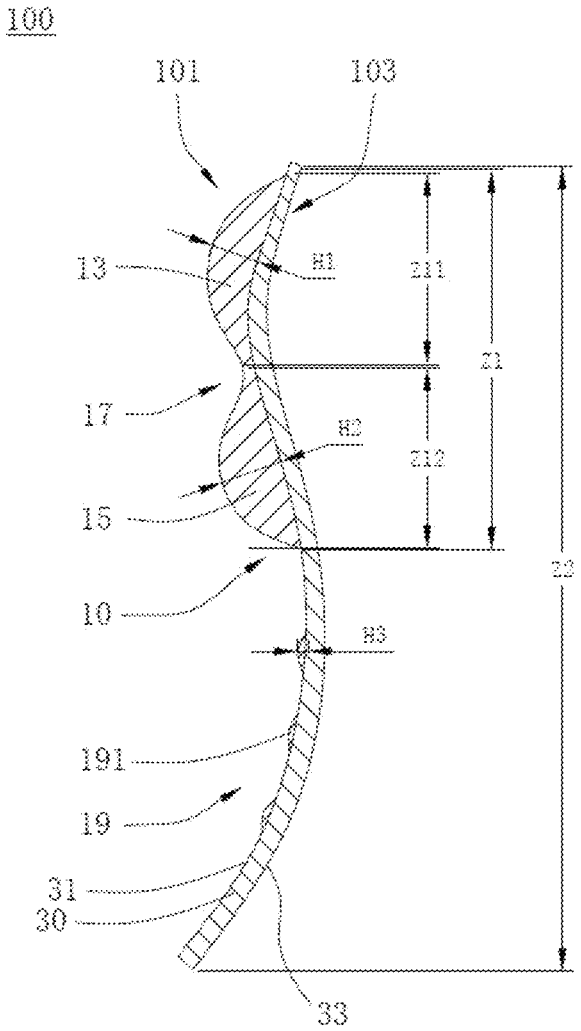
FIG. 3 is a schematic sectional view of the shoe counter assembly illustrated in FIG. 1 taken along line III-III.
Figure 7:
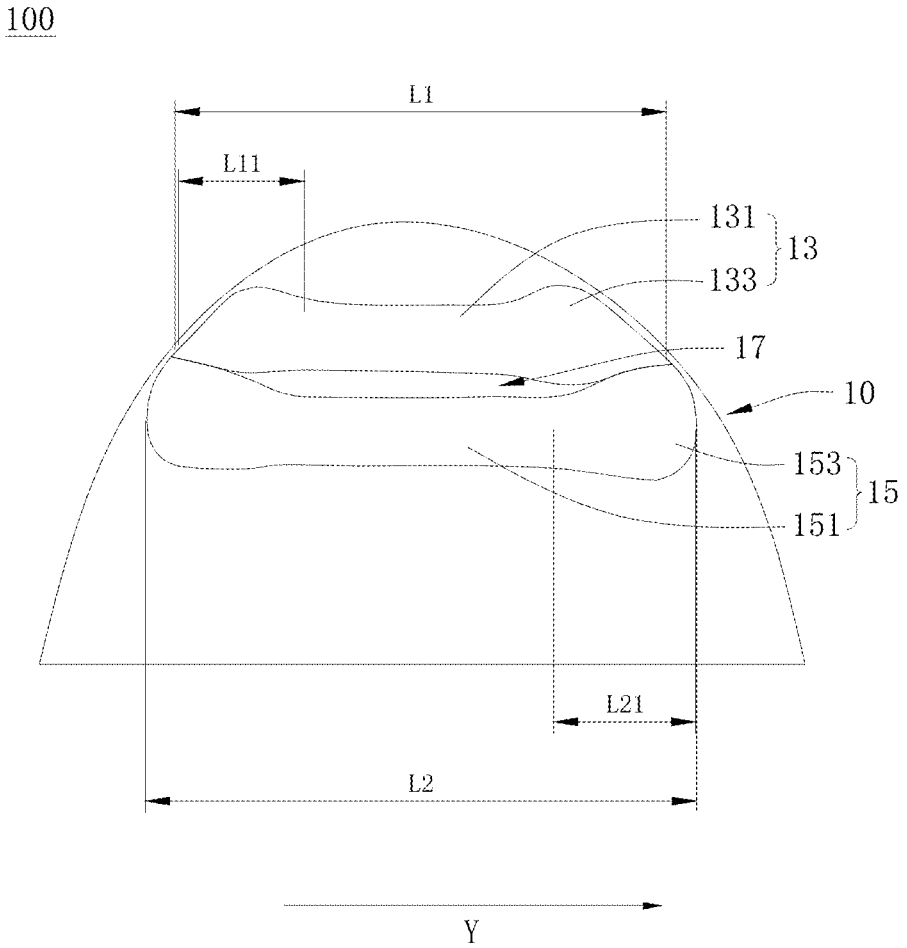
FIG. 7 is a schematic sectional view of the shoe counter assembly illustrated in FIG. 1 in an unfolded state.

Referring to FIG. 1 to FIG. 3, the shoe counter assembly 100 according to the embodiments of the present disclosure includes a wrapping member 10 and a supporting member 30. The supporting member 30 includes a first side 31 and a second side 33 which are opposite to each other. The wrapping member 10 protrudes from the first side 31 of the supporting member 30 in a direction away from the second side 33 of the supporting member 30. The wrapping member 10 includes at least two projections 11, and the at least two projections 11 are arranged in sequence in a height direction X of the shoe counter assembly 100. As shown in FIGS. 1 and 7, the overall width of the heel counter assembly 100 gradually increases from top to bottom. This configuration allows the heel counter to conform more closely to the anatomical shape of the user's heel, thereby improving the stability and wrapping performance of the rear portion of the shoe. Such a design also helps distribute pressure more evenly during walking or running, effectively enhancing wearing comfort and reducing the likelihood of heel slippage.

Figure 8:
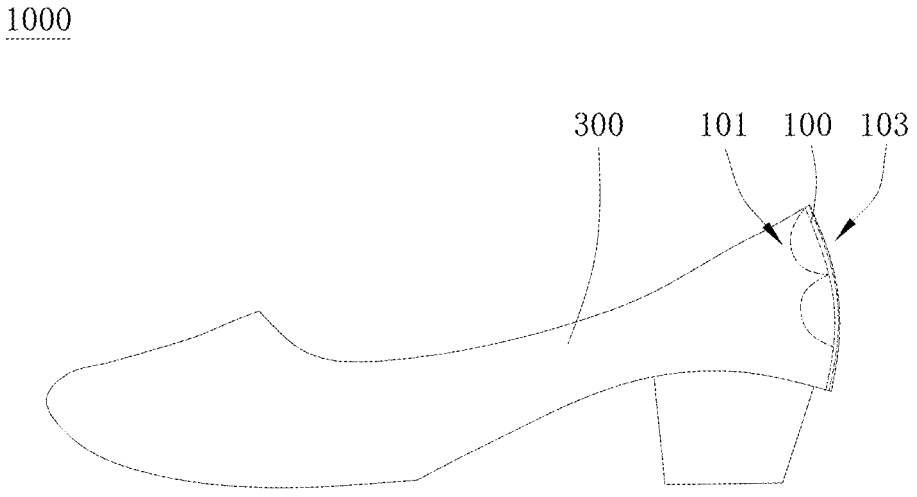
FIG. 8 is a schematic structural view of a shoe in some embodiments of the present disclosure.

Specifically, referring to FIG. 8, the shoe counter assembly 100 is connected with an upper 300, and installed at a foot heel of the shoe 1000. The shoe counter assembly 100 is configured to enhance hardness of the shoe heel, and can further support and shape the shoe heel, thus improving aesthetics of the shoe 1000. The provision of the shoe counter assembly 100 enables the overall support and stability of the shoe 1000 to be improved, thus reducing the foot from waggling and being twisted while walking. The way of connecting the shoe counter assembly 100 and the upper 300 is not limited to sewing or pressing, as long as the shoe counter assembly 100 may be firmly connected with the upper 300.

The supporting member 30 plays a role in supporting and shaping, so as to make the shape of the shoe counter assembly 100 more stereoscopic, and thus the overall aesthetics of the shoe 1000 is good. The supporting member 30 is a structure with a certain hardness, so that the supporting member 30 can better protect the foot heel of the user when the user wears the shoe. In an embodiment, a material of the supporting member 30 may be thermoplastic polyurethane (TPU), EVA-solid sponge (ESS), acrylonitrile-butadine-styrene (ABS), polyurethane (PU), hytrel or the like. In this embodiment, the supporting member 30 has high hardness and light weight. In an embodiment, the supporting member 30 includes a counter body 301 configured to provide a supporting function.

In other embodiments, the supporting member 30 may further be formed by a part of the upper located at the shoe heel. In this embodiment, the part of the upper located at the shoe heel (the supporting member 30) is hard, and the supporting member 30 can not only support the shoe counter assembly 100 well, but also shape the shoe well. In an embodiment where the supporting member 30 is formed by the part of the upper 300 located at the shoe heel, the shoe counter assembly 100 is connected with the supporting member 30, so as to support the foot heel of the user well.

Referring to FIG. 1 to FIG. 3, when the user wears the shoe, the first side 31 of the supporting member 30 is closer to the foot heel of the user than the second side 33 of the supporting member 30. In the height direction of the foot heel, the foot heel includes an upper part and a lower part. It is easy to cause the problem of foot abrasion due to a fact that a top part of the shoe heel rubs against the upper part of the foot heel. The foot heel usually has a curvature, and if the curvature of the lower part of the foot heel is small, the foot heel is easy to be detached from the shoe heel, resulting in the problem of heel slippage of shoe. The wrapping member 10 is a structure for supporting and wrapping both the upper part and the lower part of the foot heel. When the user wears the shoe, the wrapping member 10 fits the upper part of the foot heel, thus reducing the problem of foot abrasion caused by a fact that the shoe heel rubs against the upper part of the foot heel. The wrapping member 10 further fits the lower part of the foot heel, thus reducing the problem of heel slippage of shoe caused by a fact that the lower part of the foot heel is detached from the shoe. The material of the wrapping member 10 may be, but is not limited to, foam, latex, PU or the like. The wrapping member 10 is a soft and elastic structure. Because the wrapping member 10 has certain elasticity, when the user wears the shoe, the wrapping member 10 is pressed against, and the wrapping member 10 tends to rebound (i.e., return to an original shape), so that the wrapping member 10 may fit the foot heel tightly, so as to protect the foot heel of the user and reduce the problems of foot abrasion and heel slippage of shoe.

The projections 11 each are a structure configured to support the foot heel of the user, and the projections 11 are soft and elastic structures. A projection(s) 11 at a higher position in the height direction X of the shoe counter assembly 100 is/are configured to fit the upper part of the foot heel, so as to reduce the problem of foot abrasion caused by direct contact and rubbing between the upper part of the foot heel and the shoe heel. A projection(s) 11 at a lower position in the height direction X of the shoe counter assembly 100 is/are configured to support the lower part of the foot heel, so that the user can wear the shoe tightly and the problem of heel slippage of shoe can be reduced.

The number of the projections 11 may be, but not limited to, two, three, four or more. When the number of the projections 11 is two, one of the projections 11 at a higher position in the height direction X of the shoe counter assembly 100 is configured to fit the upper part of the foot heel, and the other of the projections 11 at a lower position in the height direction X of the shoe counter assembly 100 is configured to support the lower part of the foot heel. When there are three projections 11, in an example, two projections 11 at a higher position in the height direction X of the shoe counter assembly 100 are configured to fit the upper part of the foot heel, and the remaining one projection 11 at the lowest position in the height direction X of the shoe counter assembly 100 is configured to support the lower part of the foot heel. In another example, one projection 11 at the highest position in the height direction X of the shoe counter assembly 100 is configured to fit the upper part of the foot heel, and the other two projections 11 at a lower position in the height direction X of the shoe counter assembly 100 are configured to support the lower part of the foot heel. When there are four projections 11, two projections 11 at a higher position in the height direction X of the shoe counter assembly 100 are configured to fit the upper part of the foot heel, and the other two projections 11 at a lower position in the height direction X of the shoe counter assembly 100 are configured to support the lower part of the foot heel.

In the shoe counter assembly 100 provided in the embodiments of the present disclosure, the wrapping member 10 protrudes from the first side 31 of the supporting member 30 in the direction away from the second side 33 of the supporting member 30, and the wrapping member 10 includes at least two projections 11. In the height direction X of the shoe counter assembly 100, a projection 11 at a higher position fits the upper part of the foot heel, so as to reduce the problem of foot abrasion caused by a fact that the shoe heel rubs against the upper part of the foot heel. A projection 11 at a lower position in the height direction X of the shoe counter assembly is configured to support the lower part of the foot heel of the user, thus reducing the problem of heel slippage of shoe. In the present disclosure, the provision of at least two projections 11 for the shoe counter assembly 100 can reduce both the problems of foot abrasion and heel slippage of shoe.

The shoe counter assembly 100 is further described with reference to the drawings as follows.

Referring to FIG. 1 and FIG. 2, in some embodiments, the shoe counter assembly 100 further includes a mesh 50, and the mesh 50 wraps the supporting member 30 and the wrapping member 10. The mesh 50 is a structure configured to wrap the supporting member 30 and the wrapping member 10, so that a complete shoe counter assembly 100 is formed and the overall aesthetics of the shoe counter assembly 100 is good. The shoe counter assembly 100 includes a first side 101 and a second side 103 which are opposite to each other. The first side 101 of the shoe counter assembly 100 is closer to the foot heel of the user than the second side 103 of the shoe counter assembly 100, and the projections 11 are located at the first side 101 of the shoe counter assembly 100. A part of the mesh 50 located at the first side 101 of the shoe counter assembly 100 is configured to be in direct contact with the foot heel. A material of the mesh 50 may be genuine leather, synthetic material and the like, where the synthetic material may be, but not limited to, polyester fiber, nylon, artificial leather and the like. When the material of the mesh 50 is the genuine leather, the mesh 50 is comfortable and breathable, and the wear resistance of the mesh 50 is also good. In an embodiment where the material of the mesh 50 is the synthetic material, the mesh 50 is light and low in cost. In an embodiment, in a process of assembling the shoe counter assembly 100, the wrapping member 10 is first placed on the first side 31 of the supporting member 30, and then the supporting member 30 and the wrapping member 10 are wrapped omnidirectionally by the mesh 50. In another embodiment, in the process of assembling the shoe counter assembly 100, the wrapping member 10 is first placed on the first side 31 of the supporting member 30, and then the mesh 50 wraps, from the second side 33 of the supporting member 30, both the wrapping member 10 and the first side 31 of the supporting member 30. The way in which the mesh 50 wraps the supporting member 30 and the wrapping 10 is not limited to pressing or sewing.

Referring to FIG. 1 and FIG. 3, in some embodiments, the wrapping member 10 includes a first projection 13 and a second projection 15. In the height direction X of the shoe counter assembly 100, the first projection 13 and the second projection 15 are arranged in sequence, and a position of the first projection 13 is higher than a position of the second projection 15.

Specifically, in the height direction X of the shoe counter assembly 100, the position of the first projection 13 is close to a top of the shoe counter assembly 100. When the user wears the shoe, the first projection 13 is at a position corresponding to the upper part of the foot heel, and the first projection 13 is configured to fit the upper part of the foot heel, so as to reduce the problem of foot abrasion caused by a fact that the top of the shoe heel rubs against the upper part of the foot heel. Because the first projection 13 is a soft and elastic structure, it is comfortable for the user to wear. There may be, but not limited to, one, two, three or more first projections 13. In an embodiment where there is only one first projection 13, it is convenient to produce the shoe counter assembly 100. In an embodiment where there are a plurality of first projections 13, the plurality of first projections 13 are sequentially arranged in the height direction of the shoe counter assembly 100, and the plurality of first projection 13 may or may not be spaced apart.

The second projection 15 is farther away from the top of the shoe counter assembly 100 than the first projection 13. When the user wears the shoe, the second projection 15 is at a position corresponding to the lower part of the foot heel of the user, and the second projection 15 is configured to support and hold against the lower part of the foot heel, so that the user may wear the shoe tightly and the problem of heel slippage of shoe can be reduced. Because the second projection 15 is a soft and elastic structure, it is comfortable for the user to wear. There may be, but not limited to, one, two, three or more second projections 15. In an embodiment where there is only one second projection 15, it is convenient to produce the shoe counter assembly 100. In an embodiment where there are a plurality of second projections 15, the plurality of second projections 15 are sequentially arranged in the height direction X of the shoe counter assembly 100, and the plurality of second projections 15 may or may not be spaced apart. The number of the first projections 13 and the number of the second projections 15 may be the same or different.

Referring to FIG. 3, in some embodiments, in the height direction X of the shoe counter assembly 100, the wrapping member 10 is located at an upper portion of the shoe counter assembly 100, and the height Z1 of the wrapping member 10 is ½ of the height Z2 of the shoe counter assembly 100.

In the height direction X of the shoe counter assembly 100, the wrapping member 10 is close to the top of the shoe counter assembly 100. In an embodiment where the height Z1 of the wrapping member 10 is less than ½ of the height Z2 of the shoe counter assembly 100, the wrapping member 10 is unable to reach the position corresponding to the lower part of the foot heel, which causes a poor supporting effect of the wrapping member 10 for the lower part of the foot heel, and the user is prone to the problem of heel slippage of shoe when wearing the shoe. In an embodiment where the height Z1 of the wrapping member 10 is greater than ½ of the height Z2 of the shoe counter assembly 100, the wrapping member 10 extends downward to a position below the lower part of the foot heel, and the user may feel that a space below the foot heel is too cramped when wearing the shoe, which makes the user feel uncomfortable in wearing the shoe. In an embodiment where the height Z1 of the wrapping member 10 is ½ of the height Z2 of the shoe counter assembly 100, and when the user wears the shoe, the wrapping member 10 may be at a position not only corresponding to the upper part of the foot heel but also corresponding to the lower part of the foot heel, so that the problems of foot abrasion and heel slippage of shoe can be well reduced.

In other embodiments of the present application, the height Z1 of the wrapping member 10 ranges between ¼ and ½ of the height Z2 of the heel counter assembly 100. When the height Z1 of the wrapping member 10 is less than one-quarter of the height Z2 of the heel counter assembly 100, the wrapping member 100 provides insufficient coverage to the heel, only enclosing the ankle and surrounding areas. During user movement, the heel may easily slip out of the wrapping member 10, leading to a "heel-slippage" phenomenon. However, when the height Z1 of the wrapping member 10 is between one-quarter and one-half of the height Z2 of the heel counter assembly 100, the wrapping member 100 effectively covers both the upper and lower portions of the heel. This increased coverage restricts relative motion between the heel and the shoe's heel counter during movement, thereby mitigating the heel-slippage issue.

In the height direction X of the shoe counter assembly 100, the height Z1 of the wrapping member 10 is a sum of the height Z11 of the first projection 13 and the height Z12 of the second projection 15. In an embodiment where the wrapping member 10 is close to the top of the shoe counter assembly 100 and the height Z1 of the wrapping member 10 is ½ of the height Z2 of the shoe counter assembly 100, the first projection 13 can be at a position corresponding to an ankle and the second projection 15 can be at a position corresponding to the lower part of the foot heel, so that the problem of foot abrasion in the upper part of the foot heel and the problem of heel slippage of shoe in the lower part of the foot heel can be well reduced. As shown in FIGS. 1, 4, 5, and 7, the first projection 13 is configured as an annular curved surface structure, and the second projection 15 is also configured as an annular curved surface structure. As shown in FIGS. 1, 3, 6, and 7, the two ends of the first projection 13 and the second projection 15 are connected to each other to form a wrapping member 10. As shown in FIGS. 1 and 7, the length L1 of the first projection 13 in the longitudinal direction (Y direction) is smaller than the length L2 of the second projection 15 in the same direction. This arrangement is more ergonomically designed, allowing the wrapping member 10 to better conform to and enclose the user's heel, thereby enhancing comfort and heel stability during wear.

In the height direction X of the shoe counter assembly 100, the height Z11 of the first projection 13 and the height Z12 of the second projection 15 may be the same. The height Z11 of the first projection 13 and the height Z12 of the second projection 15 may also be different. In an example, the height Z11 of the first projection 13 is greater than the height Z12 of the second projection 15. In this embodiment, an area where the first projection 13 fits the upper part of the foot heel is large, and the first projection 13 may well protect the upper part of the foot heel of the user from being rubbed by the shoe heel. In another example, the height Z12 of the second projection 15 is greater than the height Z11 of the first projection 13. In this embodiment, an area where the second projection 15 fits the lower part of the foot heel is large, and the second projection 15 provides a good supporting effect for the lower part of the foot heel of the user. In an embodiment, the height Z11 of the first projection 13 and the height Z12 of the second projection 15 are the same for illustration.

Referring to FIG. 3, in some embodiments, a concave 17 is provided between the first projection 13 and the second projection 15. In this embodiment, when the user wears the shoe, the area where the wrapping member 10 fits the foot heel is small. The concave 17 is configured for ventilation between the wrapping member 10 and the foot heel, so that there is no stuffiness that would otherwise be caused due to complete close fit between the foot heel and the wrapping member 10, and it is more comfortable for the user to wear the shoe. As shown in FIGS. 1 and 7, the concave 17 is surrounded and enclosed by the first projection 13 and the second projection 15. The dimension of the concave 17 in the lengthwise direction is smaller than that of the first projection 13, and also smaller than that of the second projection 15 in the same direction. Because the concave 17 is shorter in the lengthwise direction compared to both the first projection 13 and the second projection 15, the lateral sides of the heel can be covered by a larger surface area of the wrapping member 10. This configuration achieves an improved balance between breathability and wrapping performance for the heel region.

In other embodiments, in an embodiment where there are a plurality of first projections 13, the concave 17 may also be provided between adjacent ones of the plurality of first projections 13. In an embodiment where there are a plurality of second projections 15, the concave 17 may also be provided between adjacent ones of the plurality of second projections 15. In this embodiment, the area where the wrapping member 10 fits the heel is further reduced, and the plurality of concaves 17 may make the space between the wrapping member 10 and the foot heel breathable, so that the user may wear it comfortably.

Referring to FIG. 2 and FIG. 3, in some embodiments, a maximum height H2 at which the second projection 15 protrudes from the first side 31 of the supporting member 30 is greater than a maximum height H1 at which the first projection 13 protrudes from the first side 31 of the supporting member 30.

Specifically, as can be seen from the cross-sectional view illustrated in FIG. 3, the first projection 13 is an arc projection protruding from the first side 31 of the supporting member 30, and the maximum height H1 at which the first projection 13 protrudes from the first side 31 of the supporting member 30 refers to a distance between the first side 31 of the supporting member 30 and a point on a surface of the first projection 13 which protrudes the farthest from the first side 31 of the supporting member 30. In an embodiment that the first projection 13 is the arc projection protruding from the first side 31 of the supporting member 30, the first projection 13 may well fit the foot shape, and it is comfortable for the user to wear. The second projection 15 is also an arc projection protruding from the first side 31 of the supporting member 30. The maximum height H2 at which the second projection 15 protrudes from the first side 31 of the supporting member 30 refers to a distance between the first side 31 of the supporting member 30 and a point on the surface of the second projection 15 which protrudes the farthest from the first side 31 of the supporting member 30. In an embodiment that the second projection 15 is the arc projection protruding from the first side 31 of the supporting member 30, the second projection 15 may well fit the foot shape, and it is comfortable for the user to wear.

Due to the curvature of the foot heel, when the user wears a shoe, the lower part of the foot heel is farther away from the shoe heel than the upper part of the foot heel. In other words, a gap between the lower part of the foot heel and the shoe heel is larger than a gap between the upper part of the foot heel and the shoe heel. If the maximum height H2 at which the second projection 15 protrudes from the first side 31 of the supporting member 30 is smaller than the maximum height H1 at which the first projection 13 protrudes from the first side 31 of the supporting member 30, when the user wears the shoe, there is still a gap between the lower part of the foot heel and the second projection 15 after the first projection 13 fits the upper part of the foot heel, and the second projection 15 is unable to support the lower part of the foot heel. In this embodiment, the supporting effect of the wrapping member 10 for the lower part of the foot heel of the user is poor. In an embodiment where the maximum height H2 at which the second projection 15 protrudes from the first side 31 of the supporting member 30 is greater than the maximum height H1 at which the first projection 13 protrudes from the first side 31 of the supporting member 30, when the user wears the shoe, the second projection 15 can support the lower part of the foot heel of the user while the first projection 13 fits the upper part of the foot heel. In this embodiment, the wrapping member 10 provides a good supporting effect for the foot heel of the user. In other embodiments of the present application, the maximum height H2 by which the second projection 15 protrudes from the first side 31 of the supporting member 30 is less than the maximum height H1 by which the first projection 13 protrudes from the first side 31 of the supporting member 30. Alternatively, the maximum height H2 of the second projection 15 may be equal to the maximum height H1 of the first projection 13 from the first side 31 of the supporting member 30. Such variations in height configuration allow for flexibility in adjusting the fit and contour of the wrapping member based on different design needs or user foot shapes, thereby enhancing the adaptability and ergonomic performance of the shoe.

Figure 4:
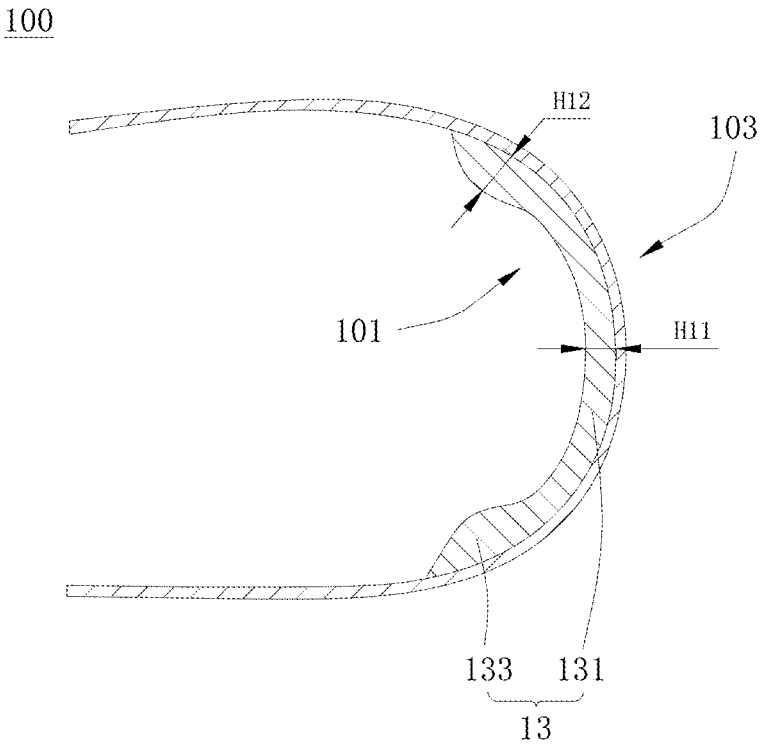
FIG. 4 is a schematic sectional view of the shoe counter assembly illustrated in FIG. 1 taken along line IV-IV.
Figure 5:
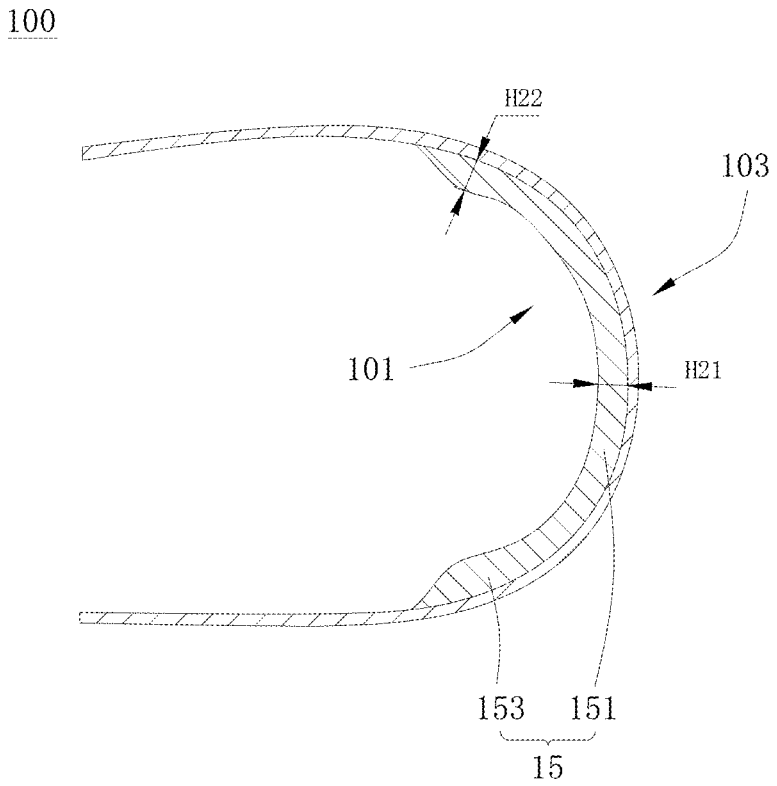
FIG. 5 is a schematic sectional view of the shoe counter assembly illustrated in FIG. 1 taken along line V-V.

Referring to FIG. 2, FIG. 4 and FIG. 5, in some embodiments, the first projection 13 includes a first base portion 131 and a first protruding portion 133. The first protruding portion 133 is at least provided at one free end of the first projection 13. The height H12 at which the first protruding portion 133 protrudes from the first side 31 of the supporting member 30 is greater than the height H11 at which the first base portion 131 protrudes from the first side 31 of the supporting member 30. The second projection 15 includes a second base portion 151 and a second protruding portion 153. The second protruding portion is at least provided at one free end of the second projection 15. The height H22 at which the second protruding portion 153 protrudes from the first side 31 of the supporting member 30 is greater than the height H21 at which the second base portion 151 protrudes from the first side 31 of the supporting member 30.

Referring to FIG. 8, in some embodiments, after the shoe counter assembly 100 is connected with the upper 300, the shoe counter assembly 100 is in a curved structure capable of surrounding the foot, so that the first projection 13 is in a curved structure capable of surrounding the ankle, and the second projection 15 is also in a curved structure capable of surrounding the lower part of the foot heel. The curved first projection 13 and the curved second projection 15 can support and wrap the foot heel of the user, and it is comfortable for the user to wear. In other embodiments of the present application, the protruding height H12 of the first protruding portion 133 from the first side 31 of the supporting member 30 is less than the protruding height H11 of the first base portion 131 from the first side 31 of the supporting member 30. Alternatively, the protruding height H12 of the first protruding portion 133 may be equal to the protruding height H11 of the first base portion 131 from the first side 31 of the support member 30. In other embodiments of the present application, the protruding height H22 of the second protruding portion 153 from the first side 31 of the supporting member 30 is equal to the protruding height H21 of the second base portion 151 from the first side 31 of the supporting member 30. Alternatively, the protruding height H22 of the second protruding portion 153 may be less than the protruding height H21 of the second base portion 151 from the first side 31 of the support member 30. These structural variations provide enhanced flexibility for tailoring the heel counter design to accommodate different foot shapes or support preferences, allowing for improved comfort, fit, and performance in various shoe configurations.

Referring to FIG. 2 and FIG. 4, in some embodiments, the first protruding portion 133 is configured to support a lateral position of the upper part of the foot heel, which can reduce the problem of foot abrasion caused by direct rubbing between the lateral position of the upper part of the foot heel and the upper 300. When the user wears a shoe, there is a certain gap between the lateral position of the upper part of the foot heel and the upper 300 due to different foot shapes of different people. In an embodiment where the height H12 at which the first protruding portion 133 protrudes from the first side 31 of the supporting member 30 is less than or equal to the height H11 at which the first base portion 131 protrudes from the first side 31 of the supporting member 30, there may be a gap between the lateral position of the upper part of the foot heel and the first protruding portion 133, so that it is difficult for the first protruding portion 133 to fit the lateral position of the upper part of the foot heel, and the first protruding portion 13 is poor in supporting and wrapping the upper part of the foot heel. In an embodiment where the height H12 at which the first protruding portion 133 protrudes from the first side 31 of the supporting member 30 is greater than the height H11 at which the first base portion 131 protrudes from the first side 31 of the supporting member 30, the first protruding portion 133 may fill the gap between the lateral position of the upper part of the foot heel and the upper 300, so that the first protruding portion 13 provides good wrapping and support for the lateral position of the upper part of the foot heel, and the user may wear the shoe stably, thus reducing the problem of heel slippage of shoe.

In some embodiments, the first projection 13 is provided with one first protruding portion 133. The first protruding portion 133 may be provided at any one of two free ends of the first projection 13. Such arrangement of the first projection 13 can reduce the foam material. Referring to FIG. 4, in another embodiment, the first projection 13 is provided with two first protruding portions 133. The two first protruding portions 133 are respectively provided at the two free ends of the first projection 13. The first projection 13 may prevent the upper 300 from rubbing against the lateral positions of the upper part of the foot heel, and the first projection 13 provides good wrapping to the upper part of the foot heel, so that the user may wear the shoe stably and comfortably. The first projection 13 of the present disclosure includes two first protruding portions 133.

Referring to FIG. 2 and FIG. 5, the second protruding portion 153 is configured to support a lateral position of the lower part of the foot heel, so as to fill the gap between the lateral position of the lower part of the foot heel and the upper 300; in this way, the user may wear the shoe stably and the problem of heel slippage of shoe can be reduced. In an embodiment where the height H22 at which the second protruding portion 153 protrudes from the first side 31 of the supporting member 30 is less than or equal to the height H21 at which the second base portion 151 protrudes from the first side 31 of the supporting member 30, when the user wears the shoe, the second protruding portion 153 may be unable to fill the gap between the lateral position of the lower part of the foot heel and the upper 300, and the second protruding portion 153 is poor in supporting and wrapping the lateral positions of the lower part of the foot heel. In an embodiment where the height H22 at which the second protruding portion 153 protrudes from the first side 31 of the supporting member 30 is greater than the height H21 at which the second base portion 151 protrudes from the first side 31 of the supporting member 30, the second protruding portion 153 may fill the gap between the lateral position of the lower part of the foot heel and the upper 300, so that the user can wear the shoes stably and the problem of heel slippage of shoe can be reduced. In this embodiment, the second protruding portion 153 provides good wrapping and support for the lateral positions of the lower part of the foot heel.

In an embodiment, the second projection 15 is provided with one second protruding portion 153. In this embodiment, the second protruding portion 153 may be provided at any one of two free ends of the second projection 15. Such arrangement of the second projection 15 can reduce the foam material. In another embodiment, referring to FIG. 2, the second projection 15 is provided with two second protruding portions 153. The two second protruding portions 153 are respectively provided at the two free ends of the second projection 15. The second projection 15 provides better support and wrapping for the foot heel, so that the user wears the shoe stably and the problem of heel slippage of shoe can be reduced, and it is comfortable for the user to wear. The second projection 15 of the present disclosure includes two second protruding portions 153.

Figure 6:
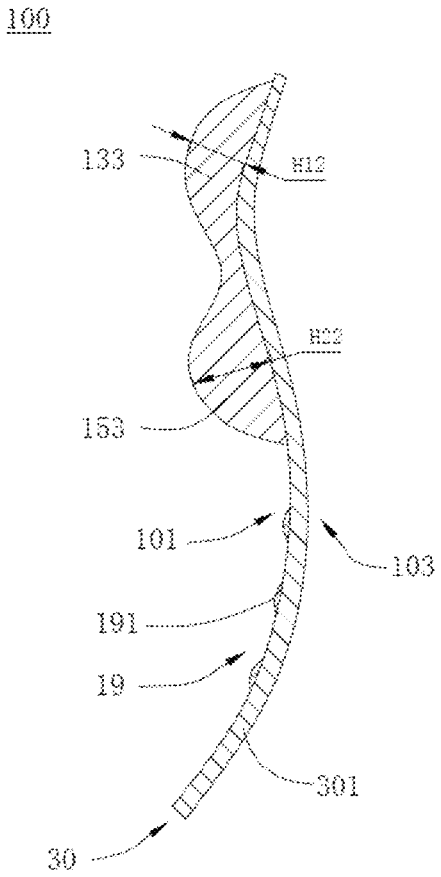
FIG. 6 is a schematic sectional view of the shoe counter assembly illustrated in FIG. 1 taken along line VI-VI.

Referring to FIG. 2 and FIG. 6, in some embodiments, the height H22 at which the second protruding portion 153 protrudes from the first side 31 of the supporting member 30 is greater than the height H12 at which the first protruding portion 133 protrudes from the first side 31 of the supporting member 30. The second protruding portion 153 provides good support for the lower part of the foot heel, and the second protruding portion 153 can completely fill the gap between the lateral position of the lower part of the foot heel and the upper 300, so that the user may wear the shoe stably, and no problem of heel slippage of shoe occurs.

Referring to FIG. 7, in some embodiments, in a length direction Y of the shoe counter assembly 100 being in an unfolded state (that is a state in which the shoe counter assembly is not bent/curved), a length L11 of the first protruding portion 133 is greater than or equal to 10% of a length L1 of the first projection 13, and smaller than or equal to 15% of the length L1 of the first projection 13; and a length L21 of the second protruding portion 153 is greater than or equal to 10% of a length L2 of the second projection 15, and smaller than or equal to 15% of the length L2 of the second projection 15.

Specifically, the length of one first protruding portion 133 is greater than or equal to 10% of the length L1 of the first projection 13, and smaller than or equal to 15% of the length L1 of the first projection 13; and the length L21 of one second protruding portion 153 is greater than or equal to 10% of the length L2 of the second projection 15, and smaller than or equal to 15% of the length L2 of the second projection 15.

In an embodiment where the length L11 of the first protruding portion 133 is less than 10% of the length L1 of the first projection 13, an area where the first protruding portion 133 fits the lateral position of the upper part of the foot heel is small, and the first protruding portion 133 is unable to fill the gap between the lateral position of the upper part of the foot heel and the upper 300 (illustrated in FIG. 4), which causes the first protruding portion 133 to be poor in supporting and wrapping the upper part of the foot heel. In the embodiment where the length L11 of the first protruding portion 133 is greater than 15% of the length L1 of the first projection 13, the first protruding portion 133 extends from the lateral position of the upper part of the foot heel to a center position of the upper part of the foot heel. When the shoe is worn, the first protruding portion 133 extending to the center position of the upper part of the foot heel may make a space between the upper part of the foot heel and the shoe heel too cramped, which makes the user feel uncomfortable when wearing the shoe. In an embodiment where the length L11 of the first protruding portion 133 is greater than or equal to 10% of the length L1 of the first projection 13 and smaller than or equal to 15% of the length L1 of the first projection 13, the first protruding portion 133 can fill the gap between the lateral position of the upper part of the foot heel and the upper 300, and the first protruding portion 133 provides good support and wrapping for the upper part of the foot heel; in addition, the first protruding portion 133 does not extend from the lateral position of the upper part of the foot heel to the center position of the upper part of the foot heel.

Referring to FIG. 7, in an embodiment where the length L21 of the second protruding portion 153 is less than 10% of the length L2 of the second projection 15, an area where the second protruding portion 153 fits the lateral position of the lower part of the foot heel is small, the second protruding portion 153 is unable to fill the gap between the lateral position of the lower part of the foot heel and the upper 300, and the second protruding portion 153 is poor in supporting and wrapping the lower part of the foot heel. In an embodiment where the length L21 of the second protruding portion 153 is greater than 15% of the length L2 of the second projection 15, the second protruding portion 153 extends from the lateral position of the lower part of the foot heel to a center position of the lower part of the foot heel, and the second protruding portion 153 extending to the center position of the lower part of the foot heel make a space between the lower part of the foot heel and the shoe heel too cramped, which makes the user feel uncomfortable when wearing the shoe. In an embodiment where the length L21 of the second protruding portion 153 is greater than or equal to 10% of the length L2 of the second projection 15 and smaller than or equal to 15% of the length L2 of the second projection 15, the second protruding portion 153 can fill the gap between the lateral position of the lower part of the foot heel and the upper 300, and the second protruding portion 153 provides good support and wrapping for the lower part of the foot heel; in addition, the second protruding portion 153 does not extend from the lateral position of the lower part of the foot heel to the center position of the lower part of the foot heel.

Refer to FIG. 1 and FIG. 3, in some embodiments, the shoe counter assembly 100 further includes a texture structure 191, and the texture structure 191 is provided on the first side 101 of the shoe counter assembly 100. In the height direction X of the shoe counter assembly 100, the texture structure 191 is provided in a texture area 19, and the texture area 19 is an area on the first side 101 of the shoe counter assembly 100 where neither the first projection 13 nor the second projection 15 is provided. The texture structure 191 and the first projection 13 are respectively located at two opposite sides of the second projection 15.

In the height direction X of the shoe counter assembly 100, the texture area 19 is provided below the second projection 15. When the user wears the shoe, the texture area 19 is at a position corresponding to the bottom of the foot heel (which is beneath the lower part of the foot heel). The texture structure 191 is provided in the texture area 19, and the texture structure 191 may be evenly or unevenly distributed in the texture area 19. The texture structure 191 is configured to increase the friction between the shoe counter assembly 100 and the bottom of the foot heel, so as to further make the user wear the shoe stably and reduce the problem of heel slippage of shoe. The texture structure 191 is a wavy strip structure. In an embodiment, the texture structure 191 slightly protrudes from the first side 101 of the shoe counter assembly 100 in the direction away from the second side 103 of the shoe counter assembly 100. In this embodiment, a surface of the shoe counter assembly 100 below the second projection 15 is rough and uneven, so that the friction between the shoe counter assembly 100 and the foot heel can be increased, and the problem of heel slippage of shoe can be further reduced. In another embodiment, the texture structure 191 is slightly recessed from the first side 101 of the shoe counter assembly 100 in the direction facing the second side 103 of the shoe counter assembly 100, so that the surface of the shoe counter assembly 100 below the second projection 15 is rough and uneven, thereby increasing the friction between the shoe counter assembly 100 and the foot heel and further reducing the problem of heel slippage of shoe. As shown in FIG. 3, the maximum height H3 by which the texture structure 191 protrudes from the first side 31 of the supporting member 30 is smaller than the maximum height H2 by which the second projection 15 protrudes from the first side 31 of the supporting member 30, and is also smaller than the maximum height H1 by which the first projection 13 protrudes from the same side. This hierarchical height arrangement helps maintain a multi-level surface profile, which can enhance the frictional engagement between the heel and the support structure, while also contributing to aesthetic design or breathability, depending on the material and surface treatment.

Referring to FIG. 8, the shoe 1000 provided in the embodiments of the present disclosure includes the shoe counter assembly 100 according to any of the above embodiments and the upper 300, and the shoe counter assembly 100 is connected with the upper 300.

In the shoe counter assembly 100 provided in the embodiments of the present disclosure, the wrapping member 10 protrudes from the first side 31 of the supporting member 30 in the direction away from the second side 33 of the supporting member 30, and the wrapping member 10 includes at least two projections 11. Some projection(s) 11 at a higher position in the height direction X of the shoe counter assembly 100 is/are configured to fit the upper part of the foot heel, so as to reduce the problem of foot abrasion caused by direct contact and rubbing between the upper part of the foot heel and the shoe heel. Some projection(s) 11 at a lower position in the height direction X of the shoe counter assembly 100 is/are configured to support the lower part of the foot heel, so that the problem of dropping off of shoes can be reduced. In the present disclosure, the provision of the at least two projections 11 for the shoe counter assembly 100 enables both the problems of foot abrasion and heel slippage of shoe to be alleviated.

The technical features of the embodiments mentioned above may be combined arbitrarily. For conciseness of the description, not all possible combinations of the technical features in the embodiments mentioned above are described. However, as long as there is no contradiction between the combinations of these technical features, they shall be construed as falling within the scope described in the specification. Meanwhile, other embodiments may be derived from the embodiments above, so that structural and logical substitutions and changes may be made without departing from the scope of the present disclosure.

The embodiments mentioned above only express several implementations of the present disclosure, and the description thereof is specific and detailed, but it cannot be construed as limitations on the scope. It is noted for those skilled in the art that, several modifications and improvements may be made without departing from the concept of the present disclosure, and all of them fall within the protection scope of the present disclosure. Therefore, the scope of protection of the present disclosure shall be subject to the appended claims.

What is claimed is:

1. A shoe counter assembly, comprising:

a supporting member comprising a first side and a second side opposite to each other, and a wrapping member protruding from the first side in a direction away from the second side, wherein the wrapping member comprises a first projection and a second projection arranged in sequence along a height direction of the shoe counter assembly;

two ends of the first projection and the second projection being connected to each other such that a continuous curved surface is formed on a side of the wrapping member opposite to the supporting member along the height direction;

wherein the first projection comprises a first base portion and a first protruding portion, the first protruding portion is at least provided at one free end of the first projection; each of the first base portion and the first protruding portion protrudes from the first side in the direction away from the second side, and a height at which the first protruding portion protrudes from the first side is greater than a height at which the first base portion protrudes from the first side;

the second projection comprises a second base portion and a second protruding portion, the second protruding portion is at least provided at one free end of the second projection; each of the second base portion and the second protruding portion protrudes from the first side in the direction away from the second side, and a height at which the second protruding portion protrudes from the first side is greater than a height at which the second base portion protrudes from the first side;

when the shoe counter assembly is in use, the first projection and the second projection are configured to wrap at least a rear side of a foot heel of a user, the first protruding portion of the first projection is configured to support a lateral position of an upper part of the foot heel, and the second protruding portion of the second projection is configured to support a lateral position of a lower part of the foot heel;

wherein the continuous curved surface forms a concave enclosed by the first projection and the second projection; and wherein in the height direction of the shoe counter assembly, a height of the wrapping member equals to a sum of a height of the first projection and a height of the second projection.

2. The shoe counter assembly of claim 1, wherein a width of the concave along a lengthwise direction that is perpendicular to the height direction is less than a width of the first projection along the lengthwise direction.

3. The shoe counter assembly of claim 1, wherein a width of the concave along a lengthwise direction that is perpendicular to the height direction is less than a width of the second projection along the lateral direction.

4. The shoe counter assembly of claim 1, wherein the supporting member comprises a lower end configured to be connected to a sole, and the second projection is located between the lower end and the first projection.

5. The shoe counter assembly of claim 1, wherein a width of the first projection along a lengthwise direction that is perpendicular to the height direction is less than a width of the second projection along the lengthwise direction.

6. The shoe counter assembly of claim 1, wherein the shoe counter assembly further comprises a mesh wrapping the supporting member and the wrapping member.

7. The shoe counter assembly of claim 1, wherein a maximum height at which the first projection protrudes from the first side is greater than a maximum height at which the second projection protrudes from the first side.

8. The shoe counter assembly of claim 1, wherein a maximum height at which the second projection protrudes from the first side is equal to a maximum height at which the first projection protrudes from the first side.

9. The shoe counter assembly of claim 1, wherein a maximum height at which the first projection protrudes from the first side is less than a maximum height at which the second projection protrudes from the first side.

10. The shoe counter assembly of claim 1, wherein, in a lengthwise direction when the shoe counter assembly is in an unfolded state, a length of the first protruding portion is from 10% to 15% of a length of the first projection, and a length of the second protruding portion is from 10% to 15% of a length of the second projection.

11. The shoe counter assembly of claim 1, wherein the shoe counter assembly comprises a first side and a second side, and the first projection and the second projection are located on the first side of the shoe counter assembly;

the shoe counter assembly further comprises a texture structure provided on the first side; in the height direction, the texture structure is provided in a texture area, and the texture area is an area on the first side of the shoe counter assembly where neither the first projection nor the second projection is provided; and the texture structure and the first projection are respectively located on opposite sides of the second projection in the height direction of the shoe counter assembly.

12. The shoe counter assembly of claim 11, wherein a maximum height by which the texture structure protrudes from the first side is less than a maximum height by which the second projection protrudes from the first side, and is also less than a maximum height by which the first projection protrudes from the first side.

13. The shoe counter assembly of claim 11, wherein the texture structure is a wavy strip structure.

14. The shoe counter assembly of claim 1, wherein in the height direction of the shoe counter assembly, the height of the wrapping member is from ¼ to ½ of a height of the shoe counter assembly.

15. A shoe counter assembly, comprising:

a supporting member that defines a first side and an opposing second side; and a wrapping member extending outward from the first side in a direction away from the second side, wherein the wrapping member comprises at least a first projection and a second projection that are disposed in sequence along a height direction of the shoe counter assembly, wherein respective ends of the first projection and the second projection are joined to form a continuous curved surface on a surface of the wrapping member opposite the supporting member;

wherein the supporting member comprises a lower end configured to be connected to a sole, and the second projection is located between the lower end and the first projection;

wherein the first projection comprises a first base portion and a first protruding portion, the first protruding portion is at least provided at one free end of the first projection; each of the first base portion and the first protruding portion protrudes from the first side in the direction away from the second side, and a height at which the first protruding portion protrudes from the first side is greater than a height at which the first base portion protrudes from the first side;

wherein the second projection comprises a second base portion and a second protruding portion, the second protruding portion is at least provided at one free end of the second projection; each of the second base portion and the second protruding portion protrudes from the first side in the direction away from the second side, and a height at which the second protruding portion protrudes from the first side is greater than a height at which the second base portion protrudes from the first side;

when the shoe counter assembly is in use, the first projection and the second projection are configured to wrap at least a rear side of a foot heel of a user, the first protruding portion of the first projection is configured to support a lateral position of an upper part of the foot heel, and the second protruding portion of the second projection is configured to support a lateral position of a lower part of the foot heel;

wherein the continuous curved surface forms a concave enclosed by the first projection and the second projection; and wherein in the height direction of the shoe counter assembly, a height of the wrapping member equals to a sum of a height of the first projection and a height of the second projection.

16. A shoe, comprising:

an upper, and a shoe counter assembly connected with the upper, the shoe counter assembly comprising:

a supporting member having a first side and a second side opposite to the first side, and a wrapping member, wherein the wrapping member comprises at least a first projection and a second projection each protruding from the first side of the supporting member in a direction away from the second side of the supporting member, and the first projection and the second projection are arranged in sequence along a height direction of the shoe counter assembly;

two ends of the first projection and the second projection being connected to each other such that a continuous curved surface is formed on a side of the wrapping member opposite to the supporting member along the height direction;

wherein the first projection comprises a first base portion and a first protruding portion, the first protruding portion is at least provided at one free end of the first projection; each of the first base portion and the first protruding portion protrudes from the first side in the direction away from the second side, and a height at which the first protruding portion protrudes from the first side is greater than a height at which the first base portion protrudes from the first side;

the second projection comprises a second base portion and a second protruding portion, the second protruding portion is at least provided at one free end of the second projection; each of the second base portion and the second protruding portion protrudes from the first side in the direction away from the second side, and a height at which the second protruding portion protrudes from the first side is greater than a height at which the second base portion protrudes from the first side;

when the shoe counter assembly is in use, the first projection and the second projection are configured to wrap at least a rear side of a foot heel of a user, the first protruding portion of the first projection is configured to support a lateral position of an upper part of the foot heel, and the second protruding portion of the second projection is configured to support a lateral position of a lower part of the foot heel;

wherein the continuous curved surface forms a concave enclosed by the first projection and the second projection; and wherein in the height direction of the shoe counter assembly, a height of the wrapping member equals to a sum of a height of the first projection and a height of the second projection.

17. The shoe of claim 16, wherein in a lengthwise direction when the shoe counter assembly is in an unfolded state, a length of the first protruding portion is from 10% to 15% of a length of the first projection, and a length of the second protruding portion is from 10% to 15% of a length of the second projection.

* * * * *